United States Patent [19]

Ishikawa et al.

[11] Patent Number: 4,740,765

[45] Date of Patent: Apr. 26, 1988

[54] DIELECTRIC FILTER

[75] Inventors: Youhei Ishikawa; Sadao Yamashita, both of Kyoto; Kikuo Tsunoda, Yawata; Toshiro Hiratsuka; Kazuyoshi Miyawaki, both of Takatsuki, all of Japan

[73] Assignee: Murata Manufacturing Co., Ltd., Japan

[21] Appl. No.: 913,095

[22] Filed: Sep. 29, 1986

[30] Foreign Application Priority Data

Sep. 30, 1985 [JP] Japan ..... 60-218753
Dec. 27, 1985 [JP] Japan ..... 60-298149

[51] Int. Cl.[4] ..... H01P 1/205; H01P 7/06
[52] U.S. Cl. ..... 333/206; 333/202; 333/207; 333/222
[58] Field of Search ..... 333/202, 203, 206, 207, 333/219, 222, 223, 245, 208–212

[56] References Cited

U.S. PATENT DOCUMENTS

| | | | |
|---|---|---|---|
| 4,180,787 | 12/1979 | Pfitzenmaier | 333/212 |
| 4,418,324 | 11/1983 | Higgins | 333/219 X |
| 4,423,396 | 12/1983 | Makimoto et al. | 333/246 X |
| 4,426,631 | 1/1984 | D'Avello et al. | 333/206 X |
| 4,431,977 | 2/1984 | Sokola et al. | 333/206 |

*Primary Examiner*—Marvin L. Nussbaum
*Attorney, Agent, or Firm*—Ostrolenk, Faber, Gerb & Soffen

[57] ABSTRACT

A dielectric filter includes a single block made of dielectric material having three or more through holes in which an inner conductor is deposited to define three or more dielectric resonators coupled in a cascade manner. A reactance coupling arrangement is provided for coupling two spaced dielectric resonators with at least one dielectric resonator between them being skipped. By selecting the value of the reactance coupling arrangement, it is possible to provide a filter having a frequency characteristic in a desired format, including at least one pole at a selected point in an attenuation region thereof, without any increase in the number of stages of the dielectric resonators.

18 Claims, 9 Drawing Sheets

DIELECTRIC FILTER

BACKGROUND OF THE INVENTION

1. Field of the Invention

This invention relates to a dielectric filter comprising a plurality of dielectric resonators of which adjacent ones are connected to each other electromagnetically or via a coupling element. More particularly, the present invention relates to a band-pass type dielectric filter having a pole in an attenuation region.

2. Description of the Prior Art

In a band-pass filter, it is sometimes requested by a user that an excellent frequency attenuation should be obtained in a certain region that is separated from the center frequency by a certain degree. To accomplish the aforesaid request, in a dielectric filter comprising a plurality of resonators, whether cavity or dielectric type, of which adjacent ones are connected to each other electromagnetically or via a coupling element, one method is to increase the number of stages in the resonator. Another method, according to which no increase in the number of resonator stages is required, is to skip resonators of one or more stages and to directly connect electromagnetically the resonators on opposite sides of the skipped resonators. By this method, poles P1 and P2 appear in an attenuation region as shown by a solid line in FIG. 17 and the skirt portion of the dielectric filter characteristics becomes very steep. Consequently, the frequency attenuation becomes greater than that of the predetermined level, in a region that is separated from the center frequency by the predetermined frequency, thereby satisfying the request described above. In FIG. 17, a broken line shows the frequency characteristics of a dielectric filter having the same number of resonator stages but with no pole.

Technology for forming a pole in an attenuation region of the dielectric filter characteristics (hereinafter referred to as "polarization") as mentioned above is known and used in a cavity resonator filter or a semi-coaxial filter, but has not yet been taught or suggested to use in a dielectric filter.

SUMMARY OF THE INVENTION

The present invention has been developed with a view to substantially solving the above described disadvantages and has for its essential object to provide an improved dielectric filter which can provide a pole or poles in a frequency region adjacent the center frequency. Thus, it is possible to provide a band-pass filter, having a frequency characteristic in a desired format without any increase in the number of stages of the dielectric resonators.

It is also an essential object of the present invention to provide an improved dielectric filter of the above described type which can be easily manufactured.

In accomplishing these and other objects, a dielectric filter according to the present invention comprises three or more dielectric resonators coupled in a cascade manner, and a reactance coupling arrangement for coupling two spaced dielectric resonators with at least one dielectric resonator between them being skipped.

According to a preferred embodiment, the dielectric resonators are defined by a single block made of dielectric material having three or more first-type through holes in which an inner conductor is deposited.

BRIEF DESCRIPTION OF THE DRAWINGS

These and other objects and features of the present invention will become apparent from the following description of preferred embodiments thereof with reference to the accompanying drawings, throughout which like parts are designated by like reference numerals, and in which.

DETAILED DESCRIPTION OF EMBODIMENTS OF THE INVENTION

Figure 1:
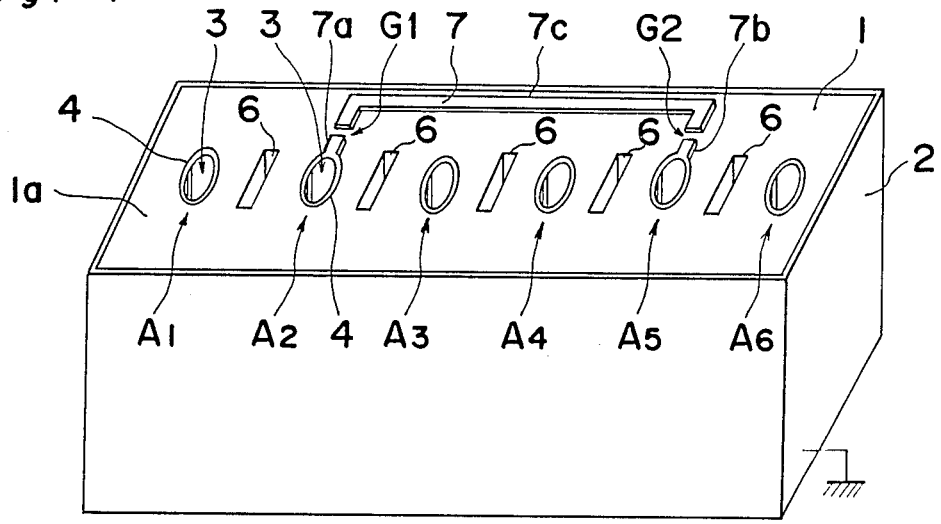
FIG. 1 is a perspective view of a dielectric filter according to a first embodiment of the present invention.

FIG. 1 shows a first embodiment of the present invention in which a dielectric filter comprises a block of dielectric resonators. Reference numeral 1 designates a block made of dielectric material, for example, consisting of a ceramic dielectric of the titanium oxide group. An outer conductor 2 made of metal film is formed on all four sides of block 1 wherein through-holes 3 are formed at a certain interval. An inner conductor 4 of metal film is formed on the inner wall of holes 3, and it is short-circuited to the outer conductor 2 via a conductive film (not shown) formed on the bottom of the block 1. (The bottom of the dielectric block is hereinafter referred to as "short-circuit end face".) Dielectric resonators A1, A2, . . . are thereby formed, each comprising inner conductor 4, outer conductor 2 and the dielectric block portion provided around the conductor 4. Between each pair of the resonators, e.g., A1 and A2, is formed a coupling hole which functions as one means for coupling the neighboring resonators and thereby adjacent resonators A1 and A2 are coupled to each other electromagnetically.

On an open end face 1*a* of dielectric block 1 on which no conductive film is formed, a reactance element 7 is provided for coupling the resonators A2 and A5 disposed on opposite sides of the skipped resonators A3 and A4. According to the embodiment shown in FIG. 1, the reactance element 7 is formed by projection electrodes 7*a* and 7*b* extending respectively from inner conductor 4 of resonators A2 and A5 and an electrode pattern 7*c* formed by silver film or the like on the open end face. The electrode pattern 7*c* comprises an elongated land portion and arms extending at a right angle at opposite ends of the land portion. Free ends of the arms are so provided as to face the free ends of projection electrodes 7*a* and 7*b*, respectively, with gaps G1 and G2 therebetween. Each of these gaps G1 and G2 forms a capacitance element, which is one example of a reactance element that may be used in the invention.

Figure 17:
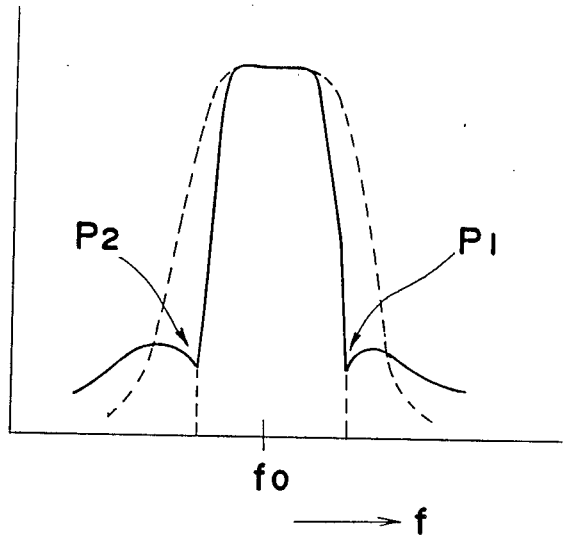
FIG. 17 is a graph showing a frequency characteristic of a filter having poles.

As mentioned above, when the resonators A2 and A5 on either side of skipped resonators A3 and A4 are connected to each other by the capacitance element, the dielectric filter characteristic is such that poles P1 and P2 appear, respectively, in upper and lower attenuation regions as shown in FIG. 17. The positions of the poles P1 and P2 vary, depending upon the degree of the impedance of the reactance element. Generally, the higher the impedance is, the further the poles P1 and P2 tend to be from the center frequency "fo". It is not preferable to have a reactance element having a low impedance, because in such a case, the poles will be located within the pass-band.

The aforesaid poles can be selectively formed in either upper or lower attenuation region by selecting the number of resonators to be skipped; by selecting the type (capacitive or dielectric) of the reactance elements; or by selecting the type (capacitive or dielectric) of elements for coupling the resonators (the coupling element between a pair of resonators may be such as a coupling hole or a reactance element).

Figure 2:
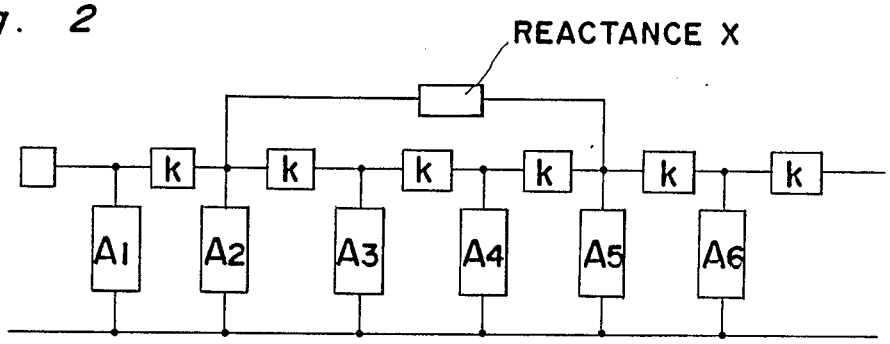
FIG. 2 is an equivalent circuit diagram of a dielectric filter according to the first embodiment of the present invention.

Referring to FIG. 2, an equivalent circuit diagram of the dielectric filter according to the present invention is shown. In FIG. 2, the reactance element 7 is indicated by X and the coupling element 6 is indicated by k. The positions of poles are indicated in Table 1 below, wherein "C" represents "capacitive element" and "L" represents "inductive element".

TABLE 1

| Number of Skipped Resonators | k | x | Position of Poles |
|---|---|---|---|
| 1 | C | C | Only in low frequency attenuation region |
| | C | L | Only in high frequency attenuation region |
| | L | C | Only in low frequency attenuation region |
| | L | L | Only in high frequency attenuation region |
| 2 | C | L | Both in low and high frequency regions |
| 2 | L | C | Both in low and high frequency regions |

According to the embodiment shown in FIG. 1, reactance element X is formed by an electrostatic capacitive element defined by the conductive pattern 7. Modifications of the capacitive element are shown in FIGS. 3 through 7.

Figure 3:
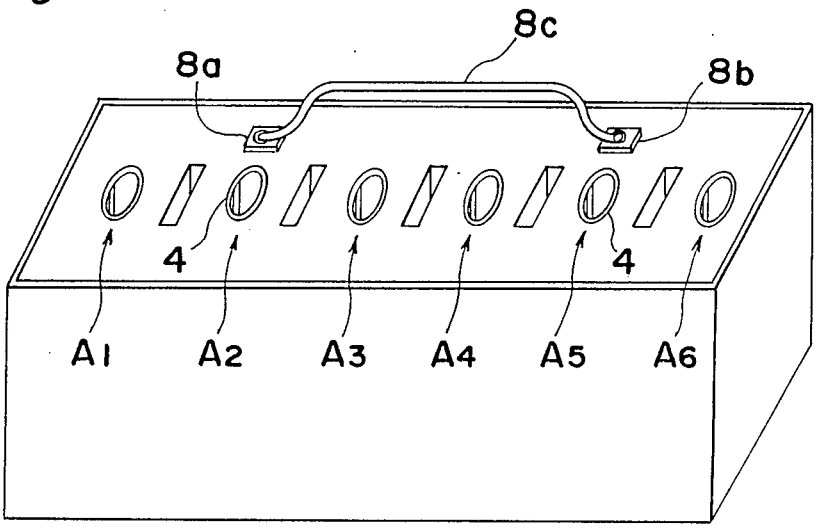
FIG. 3 is a perspective view showing a modification of the dielectric filter of FIG. 1.

Referring to FIG. 3, capacitor electrode patterns 8*a* and 8*b* are formed, respectively, at a predetermined distance from the inner conductors 4 formed in the resonators A2 and A5. The electrostatic capacitance coupling is formed between the electrode pattern 8*a* (or 8*b*) and the inner conductor 4 formed in the resonators A2 (or A5). In this case, the two capacitor electrode patterns 8*a* and 8 *b* are connected to each other by a lead wire 8*c*, or by a conductive pattern such as is shown in FIG. 1.

Figure 4:
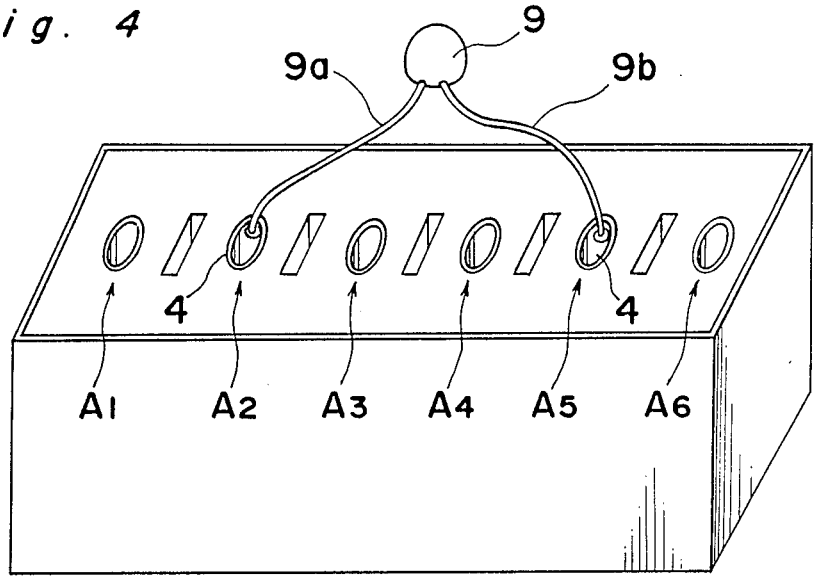
FIG. 4 is a perspective view showing another modification of the dielectric filter of FIG. 1.

Referring to FIG. 4, the electrostatic capacitance coupling is formed by a capacitor element 9 with lead wires 9*a* and 9*b*. The lead wires 9*a* and 9*b* of element 9 are respectively connected to the inner conductors 4 of resonators A2 and A5 at points near the open end faces thereof. When a trimmer capacitor is used as element 9, the capacitance can be easily changed, whereby poles can be shifted to a desired position to enable adjustment of the dielectric filter.

Figure 5A:
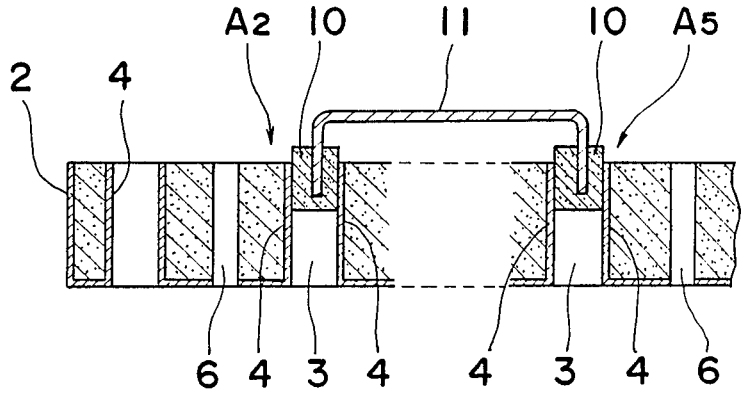
FIG. 5*a* is a cross-sectional view showing yet another modification of the dielectric filter of FIG. 1.

Referring to FIG. 5*a*, the electrostatic capacitance coupling is formed by a conductive rod 11 having opposite ends which are forced-fitted, for example into bodies 10 made of an electrically insulating material. The bodies 10 are further inserted in the holes defined by the inner conductors 4 of resonators A2 and A5. The capacitance coupling is formed between the conductive rod 11 and the inner conductor 4. Alternatively, the bodies 10 may be inserted in the coupling hole 6. In this case, the rod 11 may be directly connected to the surface of the coupling hole 6. In the foregoing examples, a capacitor element may be used instead of the conductive rod 11.

Figure 5B:
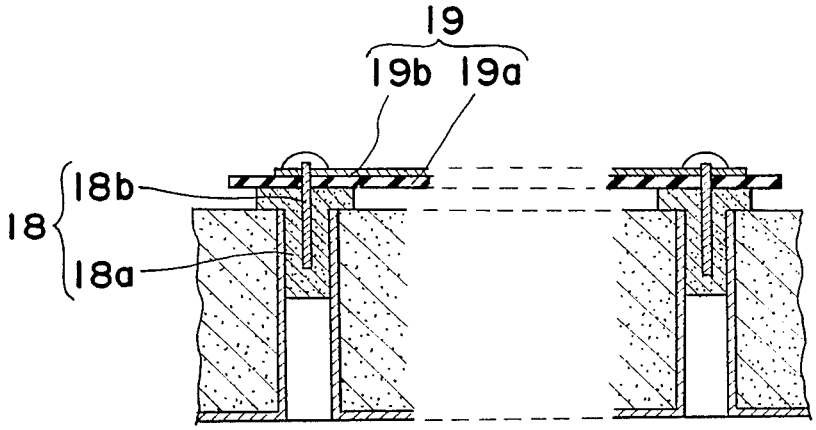
FIG. 5*b* is a cross-sectional view showing a further modification of the dielectric filter of FIG. 1.
Figure 5C:
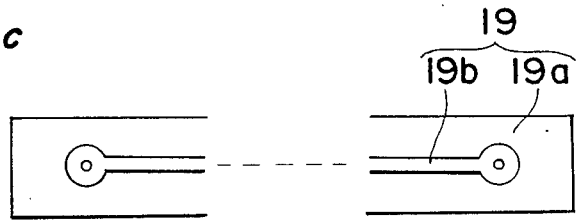
FIG. 5*c* is a top plan view showing a circuit board used in the dielectric filter of FIG. 5*b;*

Referring to FIG. 5*b*, a variation of the conductive rod 11 is shown, in which electrostatic capacitance coupling is provided by a pair of caps 18 and a printed board 19. Cap 18 is formed by a dielectric bushing 18*a* and a pin 18*b* inserted in the bushing with a portion thereof projecting from the upper face of the bushing. Printed board 19, as shown in FIG. 5*c*, has an elongated electrode pattern formed on an insulation board. Through-holes are formed at opposite ends of the elongated electrode pattern to receive the projecting ends of the pins. The pins and the electrode pattern are soldered.

Figure 6:
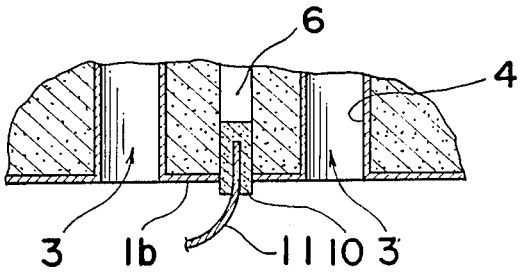
FIG. 6 is a partial cross-sectional view showing a modification of the reactance element that may be employed in the circuit of FIG. 1.

FIG. 6 shows an example wherein the body 10 carrying the conductive rod 11 is inserted into the coupling hole 6 from the bottom side of the resonator, i.e., from the short-circuit end face 1*b*. When the conductive rod 11 is inserted into the coupling hole 6 from the short-circuit end face, rod 11 can be coupled to the resonators in the same manner as described above.

Figure 7:
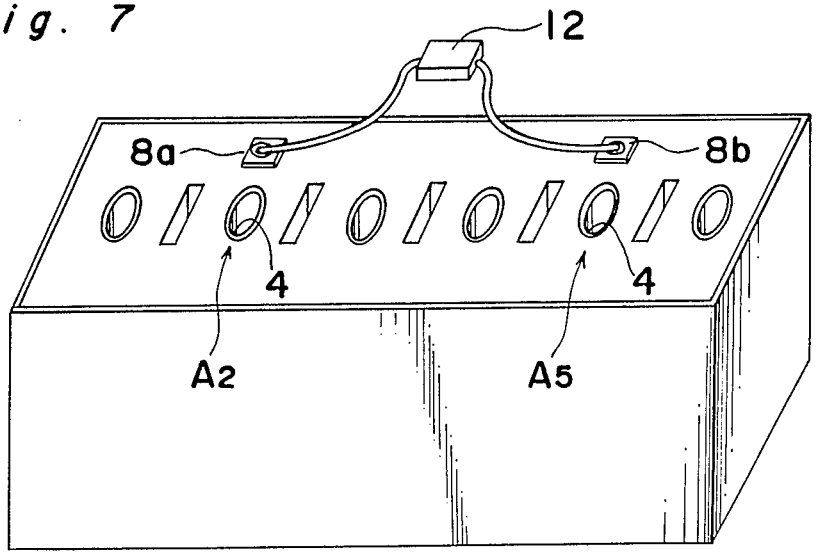
FIG. 7 is a perspective view showing a still further modification of the dielectric filter of FIG. 1.

FIG. 7 is a modification of the examples shown in FIGS. 3 and 4. The modification includes electrode patterns 8*a* and 8*b* and a trimmer capacitor 12 connected between the electrodes 8*a* and 8*b*. Thus, the capacitance couplings are formed between the inner conductor of resonator A2 and electrode 8*a*, between the inner conductor of resonator A5 and electrode 8*b*, and at trimmer capacitor 12.

Figure 8:
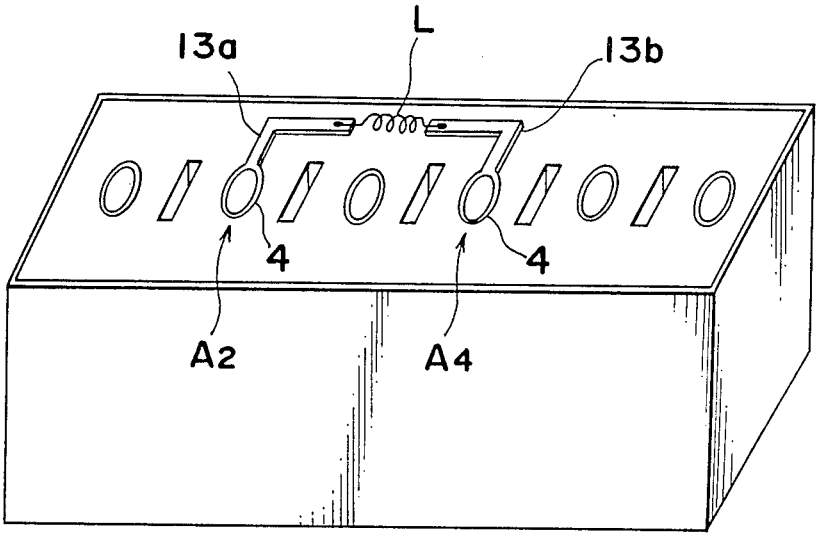
FIG. 8 is a perspective view of a dielectric filter according to a second embodiment of the present invention.

Referring to FIG. 8, a second embodiment of the present invention is shown in which a coil L is used as a reactance element X. According to this embodiment, conductive patterns 13*a* and 13*b* extend respectively, from the inner conductors 4 formed in the resonators A2 and A4. The coil element L is connected between the free ends of the conductive patterns 13*a* and 13*b*. The number of the skipped resonators is one, and both k and X have inductive property. Therefore, with this arrangement, it is possible to obtain a band-pass filter having a pole only in the upper attenuation region, as apparent from the foregoing Table 1.

Figure 9:
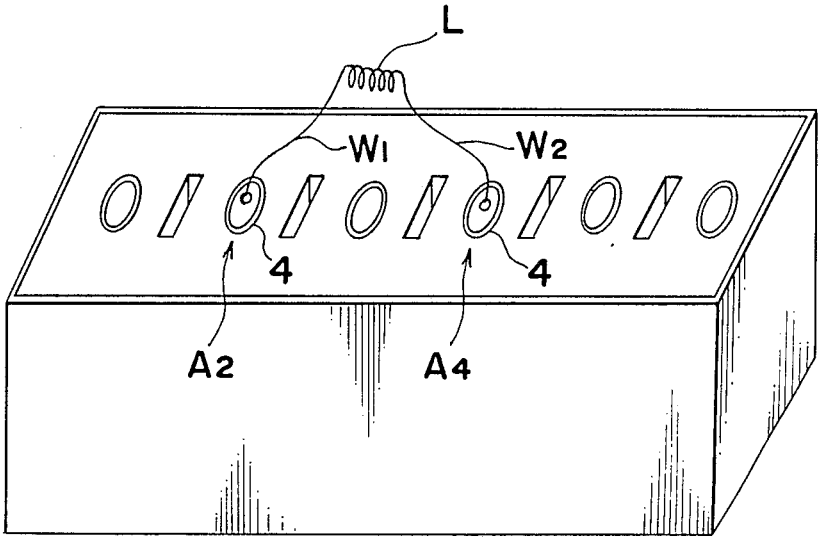
FIG. 9 is a perspective view showing a modification of the dielectric filter of FIG. 8.
Figure 10:
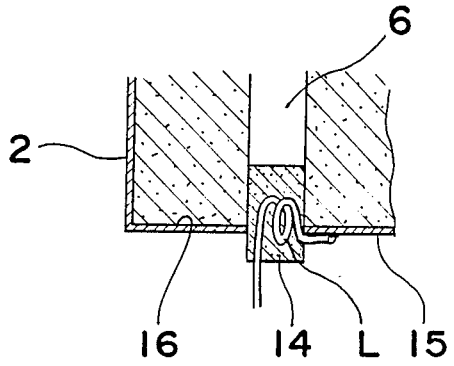
FIG. 10 is a partial cross-sectional view showing a modification of the reactance element that may be employed in the circuit of FIG. 8.

As shown in FIG. 9, lead wires W1 and W2 of the coil element L may be directly connected to the inner conductor 4 formed in the resonators A2 and A4. Alternatively, referring to FIG. 10, the coil element L itself may be inserted into the coupling hole 6 from the short-circuit end face 1*b*. In this case, it is preferable to provide the coil element L inside a body 14 so that the coil element L will not change its position. In this case, one end of the coil element L is connected to a short-circuit electrode 15 at the short-circuit end face 1*b*.

Figure 11:
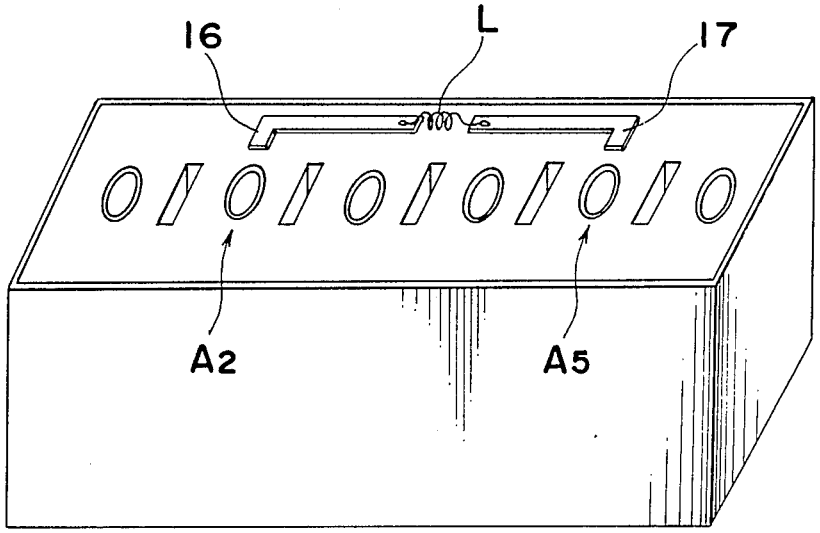
FIG. 11 is a perspective view showing another modification of the dielectric filter of FIG. 8.

FIG. 11 is an example wherein the reactance element X includes a capacitor element and a coil element. The capacitor element is formed between conductive pattern 16 and the open end face and the inner conductor 4 formed in the resonator A2 and also between conductive pattern 17 and the inner conductor 4 of resonator A5. The coil element L has its opposite ends connected to the conductive patterns 16 and 17. Table 1 does not show a case wherein the reactance element X is made of the composite circuits of a capacitor and a coil, but such a circuit has polarity, as defined herein, as well.

Figure 12:
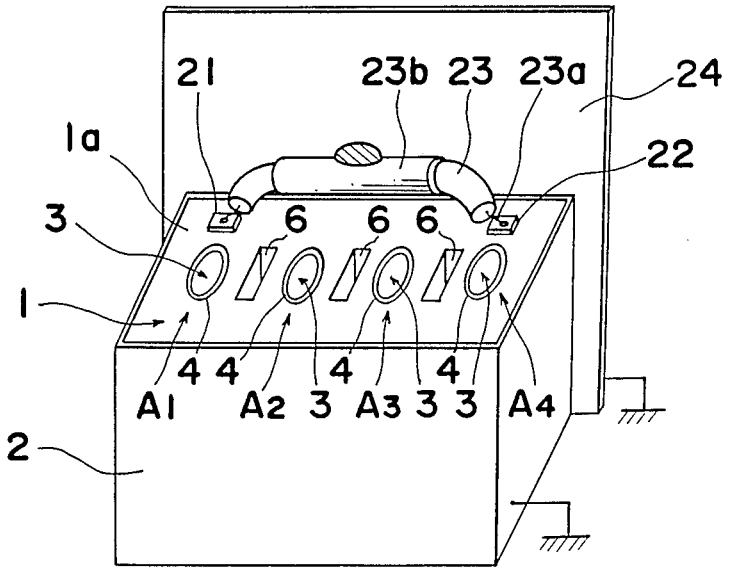
FIG. 12 is a perspective view of a dielectric filter according to a third embodiment of the present invention.
Figure 13:
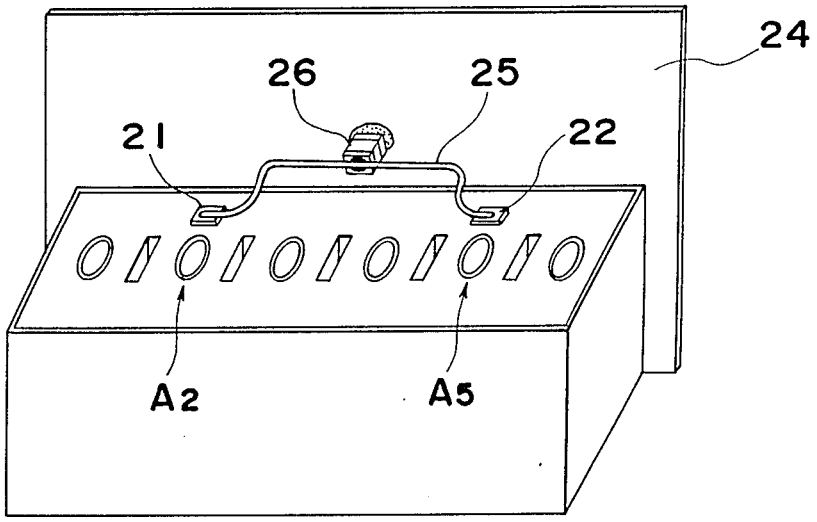
FIG. 13 is a perspective view showing a modification of the dielectric filter of FIG. 12.
Figure 14:
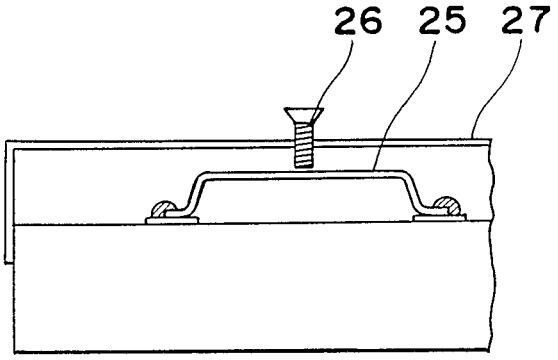
FIG. 14 is a partial view showing a modification of the reactance element that may be employed in the circuit of FIG. 12.

FIGS. 12 through 14 show a third embodiment of the present invention. In this embodiment, a reactance element with a high impedance is preferred. For example, when a capacitance element is used as a reactance element, as in FIGS. 1 and 3, the capacity of the capacitance element is preferred to be 0.05 pF or less. To this end a plurality of capacitors may be connected in series. However, from a practical viewpoint this arrangement is not preferred because it is very difficult to repeatedly manufacture a capacitor having the same low capacitance, but rather, capacitors usually have a slight degree of fluctuation in capacitance, thereby causing a considerable shift of a pole among the manufactured filters. Embodiments shown in FIGS. 12 through 14 are intended to solve such a problem and to provide a dielectric filter having a desired characteristic. This is accomplished by using a capacitor having a capacitance enough for easy manufacture.

The embodiment shown in FIG. 12 is a dielectric filter having four dielectric resonators A1 through A4. Electrode patterns 21 and 22 are formed on the open end face at a predetermined distance away from the inner conductors 4 of the resonators A1 and A4, respectively. These patterns 21 and 22 are connected to each other by a core wire 23*a* of a semi-rigid cable. The sheathing 23*b* of the semi-rigid cable is connected to a panel 24 connected to the ground.

Figure 15A:
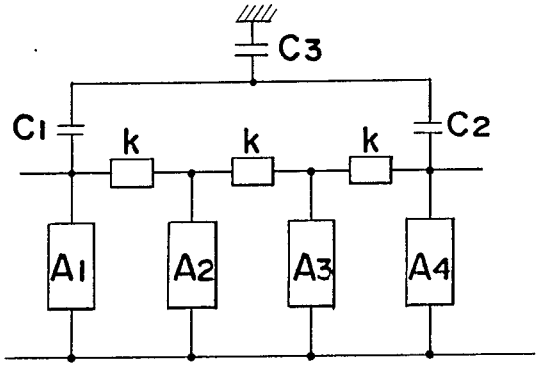
FIGS. 15*a* and 15*b* are equivalent circuits of the circuit of FIG. 12 expressed using a lumped constant.
Figure 15B:
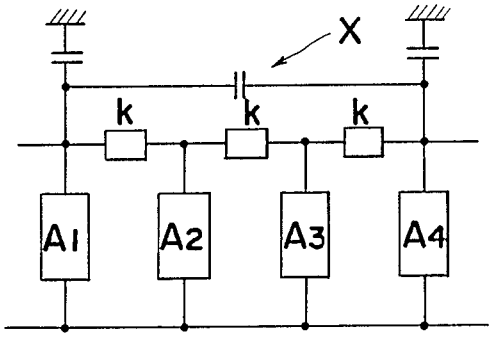

According to the above embodiment, a capacitance is formed between the inner conductors 4 formed in the resonators A1 and A4 and the capacitor electrode patterns 21 and 22 respectively. Also, a capacitance is formed between core wire 23*a* and sheathing 23*b*. Therefore, the dielectric filter of FIG. 12 has an equivalent as shown in FIG. 15*a* in which a lumped constant is used. Reference characters C1 and C2 in FIG. 15*a* show the capacitance between the inner conductor 4 and the corresponding electrode pattern, and a reference character C3 shows the capacitance between core wire 23*a* and sheathing 23*b* of the semi-rigid cable 23, i.e., between the circuit and the ground. In FIG. 15*a*, capacitors C1, C2 and C3 are shown as connected in a star (or Y) connection. When they are converted to a delta (or Δ) connection, the equivalent circuit would be as shown in FIG. 15*b*. In this case, the impedance of the reactance element X can be expressed as follows:

$$X = \frac{Z1\,Z2 + Z2\,Z3 + Z3\,Z1}{Z3}$$

wherein $Z1 = 1/j\omega C1$, $Z2 = 1/j\omega C2$ and $Z3 = 1/j\omega C3$ When $Z1 = Z2 = Z3$, the above equation can be simplified as follows:

$$Z1 = Z2 = Z3 = X/3$$

Consequently, capacitors C1, C2 and C3 can be increased to three times the capacitance required for the reactance element X. For example, when the reactance element X with 0.05 pF is required, each of the capacitors C1, C2 and C3 may be as large as 0.15 pF, thereby making it easy to manufacture the reactance element X.

Figure 16A:
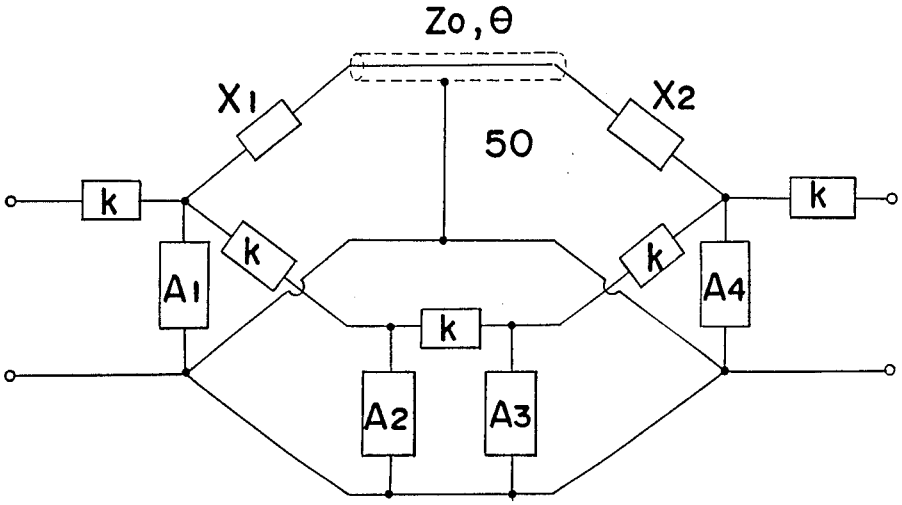
FIGS. 16*a*, 16*b* and 16*c* are equivalent circuits of the circuit of FIG. 12 expressed using a distributed constant.

Referring to FIG. 16*a*, an equivalent circuit of the filter shown in FIG. 12 is shown, but using a distributed constant. In the equivalent circuit the following parameters are used.

A1–A4: Dielectric resonators k: Coupling element for coupling the dielectric resonators A1–A4 (This may be a coupler or a microwave circuit with an electromagnetic connection)

50: Transmission line of distributed constant-type

X1 & X2: Reactance elements connected to both ends of the transmission line 50

FIG. 16*a* shows a case in which reactance elements X1 and X2, and transmission line 50 are connected in series between resonators A1 and A4 provided at opposite sides of the skipped dielectric resonators A2 and A3.

The transmission line 50 defines a distributed constant circuit and its characteristic impedance Zo and propagation constant $\theta$ may be expressed, as follows:

$$Zo = L/C \quad (1)$$

$$\theta = LC \quad (2)$$

provided that the transmission line is assumed to be a lossless line, as it is relatively short.

Figure 16B:
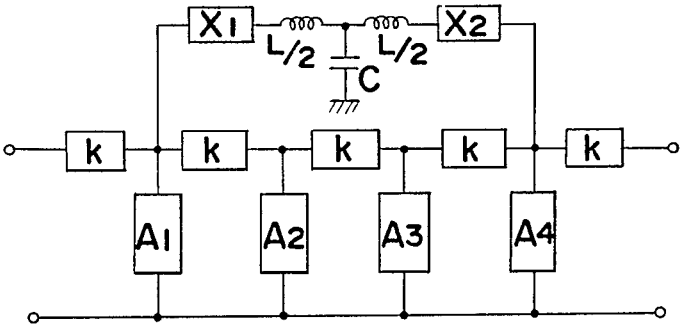
Figure 16C:
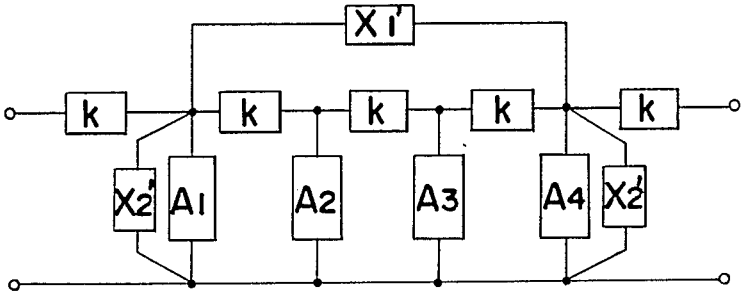

By using the above equations, the equivalent circuit in FIG. 16*a* may be modified as shown in FIG. 16*b*. Furthermore, when the "T" network of FIG. 16*b* defined by elements X1, X2, L/2, and C is converted to a "$\pi$" network, the circuit would be as shown in FIG. 16*c*. In this network, the value of X1' is determined by L and C which are given by the function of Zo and $\theta$, as apparent from equations (1) and (2). Since $\theta$ is a primary function of a frequency, the values of L and C depend on the frequency. Therefore, it is possible to vary the values of L and C in high and low frequency ranges by selecting a transmission line having different Zo and $\theta$ values. Therefore, when a polarization of a dielectric filter characteristics is achieved by a lumped constant circuit, poles appear at a position symmetrical with a center frequency. According to the present embodiment, however, they appear at a position asymmetrical with the center frequency and the appearing position can be freely controlled.

Referring to FIGS. 13 and 14, modifications of the filter shown in FIG. 12 are shown. Similar to the circuit of FIG. 12, the reactance element X shown in these modifications comprises capacitors C1, C2 and C3 in a star connection. In the embodiment in FIG. 12, the capacitance C3 is defined by a fixed capacitance between core wire 23*a* and sheathing 23*b* of the semi-rigid cable 23, but it is different in these modifications.

According to the modification of FIG. 13, the capacitance C3 is defined by a capacitor element or a trimmer capacitor element 26 provided between the lead wire 25 extending between two electrode patterns 21 and 22 and panel 24 connected to the ground.

According to modification of FIG. 14, the capacitance C3 is defined by lead wire 25 and a metal screw 26 adjustable in its axial direction to change the distance to wire 25. In FIG. 14, a metal cover 27 is provided. When the capacitance C3 is formed by the trimmer capacitor or the metal screw 26 as in the embodiment of FIG. 14, the value of the reactance element X varied, thereby enabling the shifting of poles which are produced in the attenuation region.

In the third embodiment (FIGS. 12–14), capacitances C1 and C2 are formed between the inner conductor of resonator A2 and electrode 21 and between the inner conductor of resonator A5 and electrode 22. However, the capacitances may be formed between two electrode patterns, as in FIG. 1, or may be formed at the ends of a lead wire (or the core wire of a cable) in a manner shown in FIG. 5*a*, 5*b* or 6.

Furthermore, the present invention is applicable not only to the dielectric filters comprising a block of dielectric resonators as explained in the embodiments, but also to dielectric filters defined by a plurality of dielectric resonators prepared separately. In such a case, the independent dielectric coaxial resonators are connected to each other using a coupling element such as a capacitor.

As has been fully described, a dielectric filter according to the present invention can provide a pole or poles in a frequency region adjacent the center frequency. Thus, it is possible to provide a band-pass filter, having a frequency characteristic in a desired format without any increase in the number of stages of the dielectric resonators.

Although the present invention has been fully described with reference to several preferred embodiments, many modifications and variations thereof will now be apparent to those skilled in the art, and the scope of the present invention is therefore to be limited not by the details of the preferred embodiments described above, but only by the terms of the appended claims.

What is claimed is:

1. A dielectric filter comprising:

three or more dielectric resonators coupled in a cascade manner, each dielectric resonator being a coaxial type resonator, and comprising a solid dielectric body having a main face, and formed with a first-type through hole extending into said body from said main face, an inner conductor being deposited on an inner face of said first-type through hole, and an outer conductor being deposited on at least a portion of an outer face of said dielectric body other than said main face thereof; said three or more dielectric resonators including defined first and second dielectric resonators; and reactance coupling means for coupling said first and second dielectric resonators, at least one dielectric resonator between the first and second dielectric resonators being skipped by said reactance coupling means and not coupled thereby;

wherein said dielectric resonators of said dielectric filter are defined by a single block made of dielectric material having said main face, three or more first-type through holes extending into said body from said main face in which said inner conductor is deposited, said outer conductor being deposited on at least a portion of an outer face of said block other than said main face thereof;

wherein said reactance coupling means comprises an elongated electrode deposited on said main face of said block with opposite ends thereof being located adjacent said inner conductors of said first and second dielectric resonators, respectively.

2. A dielectric filter comprising:

three or more dielectric resonators coupled in a cascade manner, each dielectric resonator being a coaxial type resonator, and comprising a solid dielectric body having a main face, and formed with a first-type through hole extending into said body from said main face, an inner conductor being deposited on an inner face of said first-type through hole, and an outer conductor being deposited on at least a portion of an outer face of said dielectric body other than said main face thereof; said three or more dielectric resonators including defined first and second dielectric resonators; and reactance coupling means for coupling said first and second dielectric resonators, at least one dielectric resonator between the first and second dielectric resonators being skipped by said reactance coupling means and not coupled thereby;

wherein said reactance coupling means comprises first and second electrodes deposited on said main face of said dielectric body adjacent said inner conductors of said first and second dielectric resonators, respectively, and a wire connected between said first and second electrodes.

3. A dielectric filter comprising:

three or more dielectric resonators coupled in a cascade manner, each dielectric resonator being a coaxial type resonator, and comprising a solid dielectric body having a main face, and formed with a first-type through hole extending into said body from said main face, an inner conductor being deposited on an inner face of said first-type through hole, and an outer conductor being deposited on at least a portion of an outer face of said dielectric body other than said main face thereof; said three or more dielectric resonators including defined first and second dielectric resonators; and reactance coupling means for coupling said first and second dielectric resonators, at least one dielectric resonator between the first and second dielectric resonators being skipped by said reactance coupling means and not coupled thereby;

wherein said reactance coupling means comprises first and second bushings made of electrically nonconductive material inserted into said first-type through holes of said first and second dielectric resonators, respectively, and wire means having portions inserted into said first and second bushings, respectively.

4. A dielectric filter as claimed in claim 3, wherein said wire means comprises a pin mounted in each bushing and a printed circuit board with an elongated electrode for connecting said pins.

5. A dielectric filter comprising:

three or more dielectric resonators coupled in a cascade manner, each dielectric resonator being a coaxial type resonator, and comprising a solid dielectric body having a main face, and formed with a first-type through hole extending into said body from said main face, an inner conductor being deposited on an inner face of said first-type through hole, and an outer conductor being deposited on at least a portion of an outer face of said dielectric body other than said main face thereof; said three or more dielectric resonators including defined first and second dielectric resonators; and reactance coupling means for coupling said first and second dielectric resonators, at least one dielectric resonator between the first and second dielectric resonators being skipped by said reactance coupling means and not coupled thereby;

wherein said reactance coupling means comprises first and second electrodes deposited on said main face of said dielectric body adjacent said inner conductors of said first and second dielectric resonators, respectively, and a capacitor connected between said first and second electrodes.

6. A dielectric filter comprising:

three or more dielectric resonators coupled in a cascade manner, each dielectric resonator being a coaxial type resonator, and comprising a solid dielectric body having a main face, and formed with a first-type through hole extending into said body from said main face, an inner conductor being deposited on an inner face of said first-type through hole, and an outer conductor being deposited on at least a portion of an outer face of said dielectric body other than said main face thereof; said three or more dielectric resonators including defined first and second dielectric resonators; and reactance coupling means for coupling said first and second dielectric resonators, at least one dielectric resonator between the first and second dielectric resonators being skipped by said reactance coupling means and not coupled thereby;

wherein said dielectric resonators of said dielectric filter are defined by a single block made of dielectric material having said main face, three or more first-type through holes extending into said body from said main face in which said inner conductor is deposited, said outer conductor being deposited on at least a portion of an outer face of said block other than said main face thereof;

wherein said block is further formed with two or more second-type through holes each located between adjacent dielectric resonators;

wherein said reactance coupling means comprises first and second bushings made of electrically nonconductive material inserted into said second-type through holes adjacent said first and second dielectric resonators, respectively, and wire means having opposite ends inserted into said first and second bushings, respectively.

7. A dielectric filter as claimed in claim 6, wherein each said second-type through hole is for coupling the corresponding said adjacent dielectric resonators.

8. A dielectric filter comprising:

three or more dielectric resonators coupled in a cascade manner, each dielectric resonator being a coaxial type resonator, and comprising a solid dielectric body having a main face, and formed with a first-type through hole extending into said body from said main face, an inner conductor being deposited on an inner face of said first-type through hole, and an outer conductor being deposited on at least a portion of an outer face of said dielectric body other than said main face thereof; said three or more dielectric resonators including defined first and second dielectric resonators; and reactance coupling means for coupling said first and second dielectric resonators, at least one dielectric resonator between the first and second dielectric resonators being skipped by said reactance coupling means and not coupled thereby;

wherein said reactance coupling means comprises coil means having first and second extending lines which are electrically connected to said inner conductors of said first and second dielectric resonators, respectively.

9. A dielectric filter as claimed in claim 8, wherein said first and second extending lines comprise first and second arm electrodes.

10. A dielectric filter comprising:

three or more dielectric resonators coupled in a cascade manner, each dielectric resonator being a coaxial type resonator, and comprising a solid dielectric body having a main face, and formed with a first-type through hole extending into said body from said main face, an inner conductor being deposited on an inner face of said first-type through hole, and an outer conductor being deposited on at least a portion of an outer face of said dielectric body other than said main face thereof; said three or more dielectric resonators including defined first and second dielectric resonators; and reactance coupling means for couping said first and second dielectric resonators, at least one dielectric resonator between the first and second dielectric resonators being skipped by said reactance coupling means and not coupled thereby;

wherein said reactance coupling means comprises coil means having first and second extending lines having respective ends located adjacent said inner conductors of said first and second dielectric resonators, respectively.

11. A dielectric filter comprising:

three or more dielectric resonators coupled in a cascade manner, each dielectric resonator being a coaxial type resonator, and comprising a solid dielectric body having a main face, and formed with a first-type through hole extending into said body from said main face, an inner conductor being deposited on an inner face of said first-type through hole, and an outer conductor being deposited on at least a portion of an outer face of said dielectric body other than said main face thereof; said three or more dielectric resonators including defined first and second dielectric resonators; and reactance coupling means for coupling said first and second dielectric resonators, at least one dielectric resonator between the first and second dielectric resonators being skipped by said reactance coupling means and not coupled thereby;

wherein said dielectric resonators of said dielectric filter are defined by a single block made of dielectric material having said main face, three or more first-type through holes extending into said body from said main face in which said inner conductor is deposited, said outer conductor being deposited on at least a portion of an outer face of said block other than said main face thereof;

wherein said block is further formed with two or more second-type through holes each located between adjacent dielectric resonators;

wherein said reactance coupling means comprises first and second bushings made of electrically nonconductive material inserted into said second-type through holes adjacent said first and second dielectric resonators, respectively, and a coil means provided in at least one of said bushings.

12. A dielectric filter as claimed in claim 11, wherein each said second-type through hole is for coupling the corresponding said adjacent dielectric resonators.

13. A dielectric filter comprising:

three or more dielectric resonators coupled in a cascade manner, each dielectric resonator being a coaxial type resonator, and comprising a solid dielectric body having a main face, and formed with a first-type through hole extending into said body from said main face, an inner conductor being deposited on an inner face of said first-type through hole, and an outer conductor being deposited on at least a portion of an outer face of said dielectric body other than said main face thereof; said three or more dielectric resonators including defined first and second dielectric resonators; and reactance coupling means for coupling said first and second dielectric resonators, at least one dielectric resonator between the first and second dielectric resonators being skipped by said reactance coupling means and not coupled thereby;

wherein said reactance coupling means comprises first and second electrodes deposited on said main face of said dielectric body adjacent said inner conductors of said first and second dielectric resonators, respectively, wire means connected between said first and second electrodes, and capacitance means having one end connected to said wire means and another end connected to ground.

14. A dielectric filter as claimed in claim 13, wherein said wire means and capacitance means are defined by a semi-rigid cable.

15. A dielectric filter comprising:

three or more dielectric resonators coupled in a cascade manner, each dielectric resonator being a coaxial type resonator, and comprising a solid dielectric body having a main face, and formed with a first-type through hole extending into said body from said main face, an inner conductor being deposited on an inner face of said first-type through hole, and an outer conductor being deposited on at least a portion of an outer face of said dielectric body other than said main face thereof; said three or more dielectric resonators including defined first and second dielectric resonators; and reactance coupling means for coupling said first and second dielectric resonators, at least one dielectric resonator between the first and second dielectric resonators being skipped by said reactance coupling means and not coupled thereby;

wherein said first and second dielectric resonators are so spaced as to skip at least two dielectric resonators therebetween, and wherein said reactance coupling means is defined by a transmission line of a distributed constant-type.

16. A dielectric filter comprising:

three or more dielectric resonators coupled in a cascade manner, each dielectric resonator being a coaxial type resonator, and comprising a solid dielectric body having a main face, and formed with a first-type through hole extending into said body from said main face, an inner conductor being deposited on an inner face of said first-type through hole, and an outer conductor being deposited on at least a portion of an outer face of said dielectric body other than said main face thereof; said three or more dielectric resonators including defined first and second dielectric resonators; and reactance coupling means for coupling said first and second dielectric resonators, at least one dielectric resonator between the first and second dielectric resonators being skipped by said reactance coupling means and not coupled thereby;

wherein said first and second dielectric resonators are so spaced as to skip at least one dielectric resonator therebetween, and wherein said reactance coupling means is defined by first and second reactance elements connected in series through a junction and a third reactance element connected between said junction and ground.

17. A dielectric filter as claimed in claim 16, wherein said first, second and third reactance elements comprise, respectively, first, second and third capacitors.

18. A dielectric filter as claimed in claim 17, wherein said third capacitor is a variable capacitor.

* * * * *